US006644777B2

(12) United States Patent
Danzuka

(10) Patent No.: US 6,644,777 B2
(45) Date of Patent: Nov. 11, 2003

(54) LIQUID EJECTING APPARATUS, AND METHOD FOR MAINTAINING AND RECOVERING EJECTION PERFORMANCE OF THE SAME

(75) Inventor: Toshimitsu Danzuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 194 days.

(21) Appl. No.: 09/817,341

(22) Filed: Mar. 27, 2001

(65) Prior Publication Data

US 2001/0035888 A1 Nov. 1, 2001

(30) Foreign Application Priority Data

Mar. 29, 2000 (JP) ..... 2000-091318

(51) Int. Cl.[7] ..... B41J 2/165
(52) U.S. Cl. ..... 347/35; 347/23
(58) Field of Search ..... 347/23, 20, 29, 347/30, 35

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 5,428,380 A | * | 6/1995 | Ebisawa | 347/35 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Thinh Nguyen
*Assistant Examiner*—Ly T Tran
(74) *Attorney, Agent, or Firm*—Fitzpatrick, Cella, Harper & Scinto

(57) ABSTRACT

In the ejection performance maintaining and recovering processing performed to a plurality of liquid ejection openings to which liquid reserved in the same liquid reservoir is supplied, even if the number of liquid ejection openings for which the maintaining and recovering processing is to be simultaneously performed changes, the ejection performance is maintained and recovered by discharging a proper amount of liquid from each of the liquid ejection openings, and the amount of liquid consumed in the ejection performance maintaining and recovering processing is reduced. An amount of liquid discharged from each of liquid ejection openings is substantially equalized, regardless of the number of liquid ejection openings to be processed.

15 Claims, 5 Drawing Sheets

LIQUID EJECTING APPARATUS, AND METHOD FOR MAINTAINING AND RECOVERING EJECTION PERFORMANCE OF THE SAME

FIELD OF THE INVENTION

The present invention relates to a liquid ejecting apparatus and a method for maintaining and recovering ejection performance of the apparatus and, more particularly, to an ink-jet printing apparatus which performs printing by ejecting liquid droplets (ink droplets) onto a printing medium, and a method for recovering ejection performance of the apparatus.

BACKGROUND OF THE INVENTION

Conventionally, a liquid ejecting apparatus such as an ink-jet printer is widely researched and developed, and has became popular as a consumer equipment.

In ink-jet printers, for example, the viscosity of ink increases upon evaporation of a solvent of ink from orifices (nozzles), and the ejection performance may deteriorate. In order to prevent this, many ink-jet printers are equipped with recovering means including pressurizing or suction means for forcibly discharging ink from the nozzle.

In recent years, a demand for higher recording speed is increased. In order to meet the demand, the number of nozzles and ink-jet printheads which are supplied the same kind of ink tend to increase.

However, if the number of nozzles or ink-jet printheads which are supplied the same kind of ink is increased, and the recover means is constructed to discharge ink from all the nozzles, there must be problems that the amount of ink consumed in recover processing increases, and hence the running cost increases.

To solve this problem, the nozzles may be divide into a several groups and recover processing may be performed in groups having nozzles for which ink discharge should be performed.

However, there must be a case that the number of groups which need recover processing is different every time the recover processing is performed, and hence the number of groups for performing the recover processing at the same time is different whenever the recover processing is performed, and a case that the number of groups for performing the recover processing at the same time is the same but the number of nozzles in the groups is different, and hence the number of nozzles for performing the recover processing at the same time is different whenever the recover processing is performed. In such a case, if the recover processing is always performed in the same way, an amount of ink discharged from one nozzle may be different whenever the recover processing is performed, since the same kind of ink is reserved in the same ink reservoir means. This causes a problem that ink may not be discharged from each nozzles in the amount required for recover processing, or an excessive amount of ink is discharged from nozzles.

SUMMARY OF THE INVENTION

It is an object of the present invention to provide a liquid ejecting apparatus which can recover ejection performance of each of liquid ejection openings by discharging a necessary amount of liquid from each ejection openings, and can reduce the amount of liquid consumed by the recover processing, if the number of ejection openings for performing the recover processing at the same time varies.

It is another object of the present invention to provide a method for maintaining and recovering ejection performance of a liquid ejecting apparatus which can recover ejection performance of each of liquid ejection openings by discharging a necessary amount of liquid from each ejection openings, and can reduce the amount of liquid consumed by the recover processing, if the number of ejection openings for performing the recover processing at the same time varies.

According to the present invention, the above object is attained by a liquid ejecting apparatus comprising:

- a plurality of liquid ejection openings to which liquid reserved in the same liquid reservoir means is supplied;
- ejection performance maintaining and recovering means for forcibly discharging the liquid from liquid ejection openings selected from the plurality of liquid ejection openings; and
- control means for controlling the ejection performance maintaining and recovering means in accordance with number of selected liquid ejection openings so as to substantially equalize an amount of ink discharged from each of the liquid ejection openings, regardless of the number of selected liquid ejection openings.

According to the present invention, another object is attained by a method for maintaining and recovering ejection performance of an apparatus having

- a plurality of liquid ejection openings to which liquid reserved in the same liquid reservoir means is supplied, said method comprising the steps of:
- ejection performance maintaining and recovering step for performing ejection performance maintaining and recovering operation which forcibly discharges the liquid from liquid ejection openings selected from the plurality of liquid ejection openings; and
- control step for controlling the ejection performance maintaining and recovering operation in accordance with number of selected liquid ejection openings so as to substantially equalize an amount of ink discharged from each of the liquid ejection openings, regardless of the number of selected liquid ejection openings.

That is, in the present invention, in an apparatus having a plurality of liquid ejection openings to which liquid reserved in the same liquid reservoir means is supplied, ejection performance maintaining and recovering operation which forcibly discharges the liquid from liquid ejection openings selected from the plurality of liquid ejection openings is performed, and the ejection performance maintaining and recovering operation is controlled in accordance with number of selected liquid ejection openings so as to substantially equalize an amount of ink discharged from each of the liquid ejection openings during the ejection performance maintaining and recovering operation, regardless of the number of selected liquid ejection openings.

According to the above arrangement, in the ejection performance maintaining and recovering operation performed for a plurality of liquid ejection openings to which liquid reserved in the same liquid reservoir means is supplied, even if the number of liquid ejection openings for which the maintaining and recovering operation is to be simultaneously executed increases, a necessary amount of liquid required for maintaining and recovering the ejection performance can be discharged from each liquid ejection openings. And even if the number of liquid ejection openings for which the maintaining and recovering operation is to be simultaneously executed decreases, the amount of liquid consumed in the maintaining and recovering operation is reduced, since the liquid is discharged no more than the necessary amount required for maintaining and recovering the ejection performance.

Therefore, the number of liquid ejection openings for which recovering operation is to be simultaneously executed changes, the original performance of the liquid ejecting apparatus can be maintained by discharging liquid in an amount large enough to recover the ejection performance from each liquid ejection openings. In addition, the running cost of the liquid ejecting apparatus can be reduced by decreasing the amount of liquid consumed for the maintaining and recovering operation.

Note that the ejection performance maintaining and recovering means may have an arrangement which includes a negative pressure generating means and forcibly discharges liquid from the selected liquid ejection openings with the negative pressure generated by the negative pressure generating means or an arrangement which includes a pressure generating means and forcibly discharges liquid from the selected liquid ejection openings with the pressure generated by the pressure generating means.

If the plurality of liquid ejection openings are divided into a plurality of liquid ejection opening groups each having a same number of liquid ejection openings, the ejection performance maintaining and recovering means is preferably configured to forcibly discharge the liquid from liquid ejection openings belonging to liquid ejection opening groups selected from the plurality of liquid ejection opening groups, and the control means is preferably configured to control the ejection performance maintaining and recovering means in accordance with number of selected liquid ejection opening groups so as to substantially equalize an amount of ink discharged from each of the liquid ejection openings by the ejection performance maintaining and recovering operation.

If the plurality of liquid ejection opening groups each having a same number of liquid ejection openings are provided on respective liquid ejecting heads, the ejection performance maintaining and recovering means is preferably configured to forcibly discharge the liquid from liquid ejection openings belonging to liquid ejecting heads selected from the plurality of liquid ejecting heads, and the control means is preferably configured to control the ejection performance maintaining and recovering means in accordance with number of selected liquid ejecting heads so as to substantially equalize an amount of ink discharged from each of the liquid ejection openings by the ejection performance maintaining and recovering operation.

It is preferable that the apparatus further comprise a detection means for detecting a liquid ejection opening that requires the ejection performance maintaining and recovering operation.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "print" is not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media.

"Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

[First Embodiment]

Figure 1:
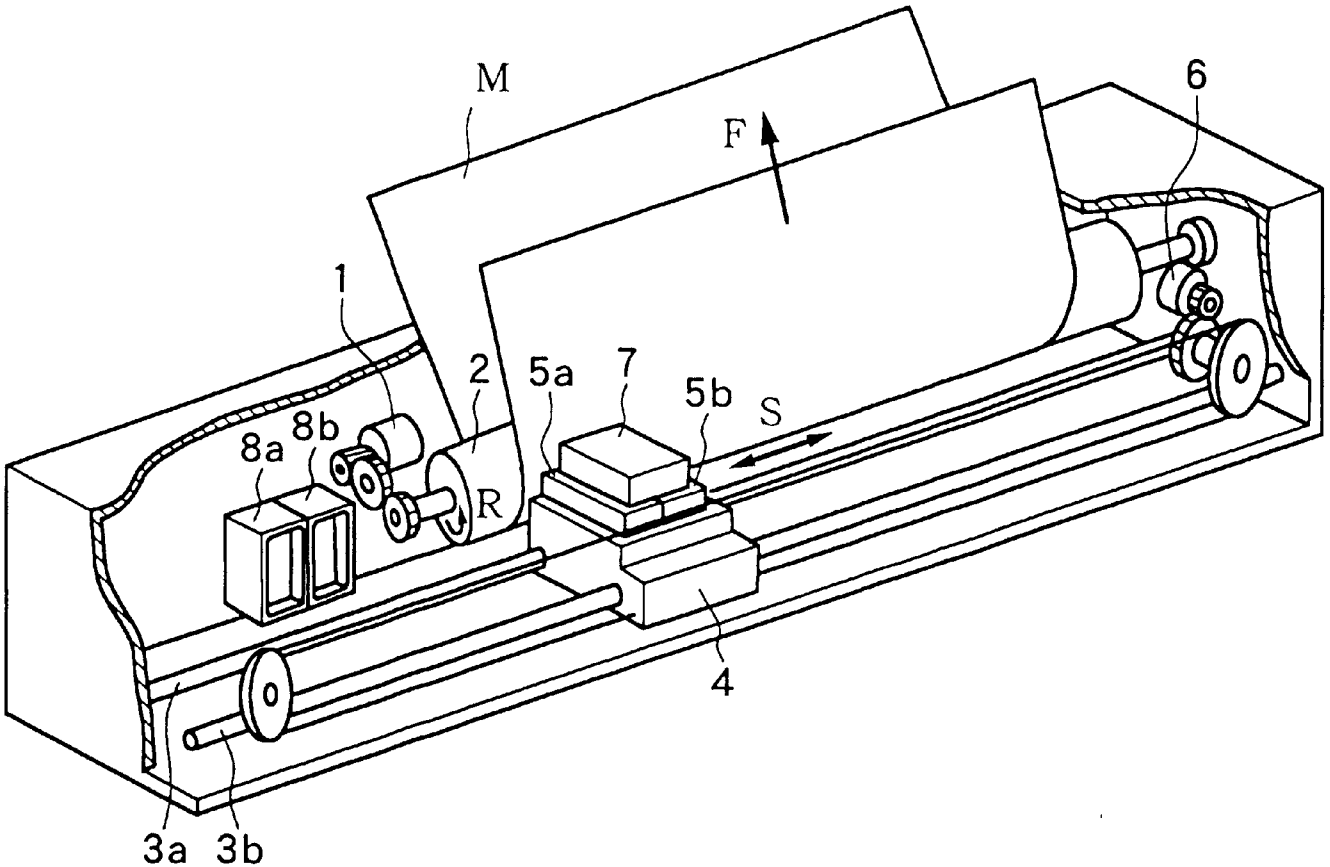
FIG. 1 is a schematic perspective view showing the outer appearance of an ink-jet printer according to the first embodiment of the present invention.

FIG. 1 is a partially sectional perspective view showing the schematic arrangement of an ink-jet printer according to the first embodiment of the present invention.

Referring to FIG. 1, a printing medium (also referred to as a medium hereinafter) M is fed in the direction indicated by an arrow F by a platen roller 2, which rotates in the direction indicated by an arrow R as a sub-scanning motor 1 is driven, and convey rollers (not shown).

Guide shafts 3*a* and 3*b* are disposed parallel in a direction perpendicular to the convey direction of this medium (sub-scanning direction). Printheads 5*a* and 5*b* mounted on a carriage 4 are reciprocally scanned in the direction indicated by an arrow S in FIG. 1 (main scanning direction) as a main-scanning motor 6 is driven.

The medium M is intermittently fed by the sub-scanning motor 1. While the medium M is stopped, the printheads 5*a* and 5*b* are reciprocally scanned in the main scanning direction and eject ink droplets corresponding to a recording signal during this scanning operation, thereby recording is performed.

Each of the printheads 5*a* and 5*b* has 256 nozzles arranged at 600-dpi intervals in the sub-scanning direction. Electrothermal transducers for locally heating ink to effect film boiling and ejecting the ink with the resultant pressure are arranged in ink channels communicating with the nozzles.

The respective ink channels communicate with common liquid chambers respectively formed in the printheads 5*a* and 5*b*. Ink reserved in a single ink cartridge 7 is supplied into these common liquid chambers.

With the two printheads 5*a* and 5*b* for ejecting the same ink, the main scanning speed can be doubled. This makes it possible to greatly increase the printing speed.

Referring to FIG. 1, reference numerals 8*a* and 8*b* denote caps connected, through tubes, to suction pumps (not shown) for discharging ink from the nozzles of the printheads 5*a* and 5*b* by suction. By independently or simultaneously driving the suction pumps, ink can be independently or simultaneously sucked and discharged from the nozzles of the printheads 5*a* and 5*b*.

An arrangement of a control section for executing printing control on the above apparatus will be described next.

Figure 4:
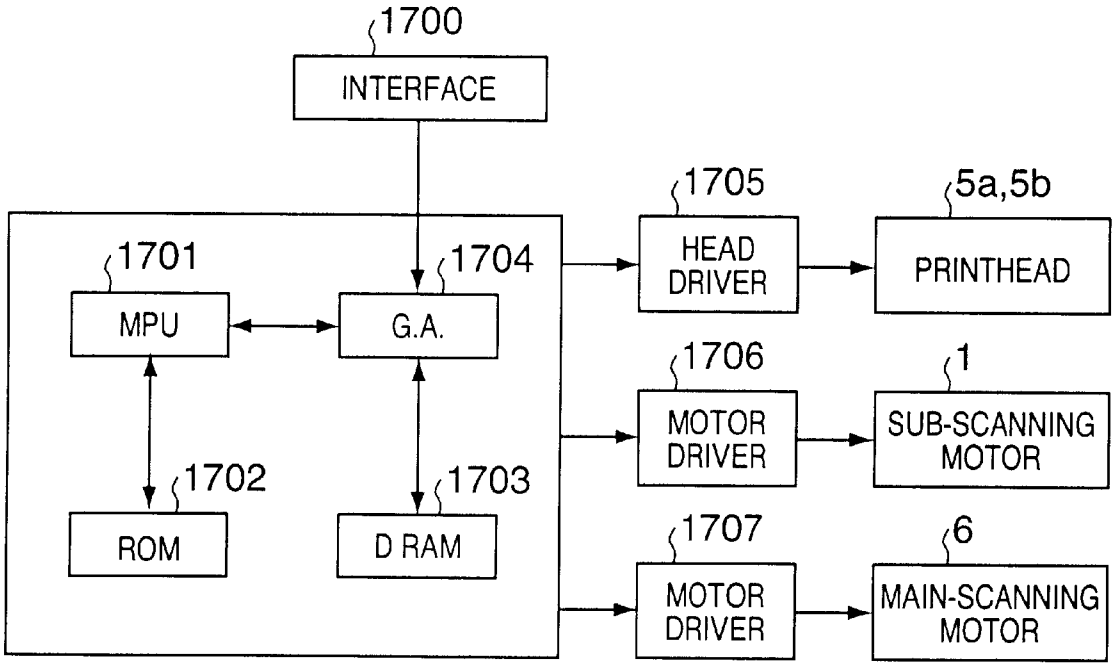
FIG. 4 is a block diagram showing a structure of the control circuit of the ink-jet printer in FIG. 1.

FIG. 4 is a block diagram showing the arrangement of the control circuit of the ink-jet printer in FIG. 1. Referring to FIG. 4 showing the control circuit, reference numeral 1700 denotes an interface for inputting a print signal; 1701, an MPU; 1702, a ROM storing a control program executed by the MPU 1701; 1703, a DRAM for storing various data (e.g., the above print signal and print data supplied to the printheads); and 1704, a gate array (G.A.) for controlling the supply of print data to the printheads 5*a* and 5*b* and also controlling data transfer among the interface 1700, MPU 1701, and DRAM 1703. The main-scanning motor 6 serves to scan the printheads 5*a* and 5*b*. The sub-scanning motor 1 serves to convey media. Reference numeral 1705 denotes a head driver for driving the printheads; and 1706 and 1707, motor drivers for driving the sub-scanning motor 1 and main-scanning motor 6, respectively.

The operation of the above control section will be described below. When a print signal is inputted to the interface 1700, the print signal is converted into print data for printing between the gate array 1704 and the MPU 1701. The motor drivers 1706 and 1707 are then driven, and the printheads are driven in accordance with the print data sent to the head driver 1705, thereby performing printing.

In this case, the control program executed by the MPU 1701 is stored in the ROM 1702. However, the printer may additionally have an erasable/writable storage medium such as an EEPROM so as to allow the host computer connected to the ink-jet printer to change the control program.

Next, a sequence of recover processing in this embodiment will be described below.

The ink-jet printer of this embodiment has dot counters for counting the numbers of dots printed by the printheads 5*a* and 5*b*. When the number of dots printed by each of the printheads 5*a* and 5*b* reaches a predetermined number (specifically, $3\times10^8$ dots in this embodiment), recover processing is performed for the corresponding printhead after printing (one page).

In this recover processing, a control section performs the following control operation to suck/discharge ink and small bubbles separated from dissolved gas in ink upon ink ejecting operation from the nozzles of the printhead. The control section moves the printheads 5*a* and 5*b* mounted on the carriage 4 to positions (to be referred to as home positions hereinafter) to oppose the suction caps 8*a* and 8*b* by driving the main scanning motor 6. The suction caps 8*a* and 8*b* are brought into contact with the printheads 5*a* and 5*b* by a cap attaching/detaching mechanism (not shown). Sucking operation is then performed by the suction pumps (not shown).

This sucking operation prevents the small bubbles from growing into large bubbles and degrading the ink ejection performance.

When the sucked/discharged ink is guided into a waste ink tank (not shown) and the sucking operation is complete, the dot counter is reset.

Note that since the numbers of dots printed by the printheads 5*a* and 5*b* differ from each other depending on the dot arrangement of an image to be printed, the above recover processing is independently performed for the printheads 5*a* and 5*b* in some cases and simultaneously performed in other cases.

The present inventors have confirmed that if the same settings are provided for the suction pumps regardless of independent or simultaneous sucking operation, since ink reserved in the same ink cartridge 7 is supplied to both of the printheads 5*a* and 5*b*, the suction abilities of the respective nozzles vary, and the suction amount becomes excessively small or large.

More specifically, it was confirmed that the suction amount in simultaneous sucking operation was smaller than that in independent sucking operation by about 20%.

In consideration of this result, in the ink-jet printer of this embodiment, to substantially equalize the suction amounts between recover processing independently performed for the printheads 5*a* and 5*b* and recover processing simultaneously performed for the printheads 5*a* and 5*b*, in the sequence of the recover processing, the driving speed of the suction pumps in the case where sucking operation is simultaneously performed for the printheads 5*a* and 5*b* is set to be higher than that in the case where sucking operation is independently performed for the printheads 5*a* and 5*b* by 20%.

Recover processing in this embodiment will be described again with reference to the flow chart of FIG. 5.

When the value of one of the dot counters for the printhead reaches a predetermined value, recover processing is started upon completion of printing on a printing medium.

First of all, the two dot counters are checked (step S51) to determine a specific printhead for which recover processing is required and also determine whether to perform recover processing for one or both of the printheads (step S52).

If it is determined that recover processing is performed for only one printhead, the driving speed of the corresponding suction pump is not changed from a predefined value. If it is determined that recover processing is performed for the two printheads, the driving speed of the suction pumps are increased from the predefined value by 20% (step S53).

The printhead is then moved to a position to oppose the suction cap (step S54), and the suction pump is driven at the set driving speed to execute suction recover processing for the respective nozzles of the printhead (step S55).

The dot counter corresponding to the printhead having undergone the recover processing is reset, and the driving speed of the suction pump is reset to the predefined value (step S56). With the above operation, the recover processing in this embodiment is completed.

As described above, according to this embodiment, a suction ability high enough to remove generated small bubbles can be ensured not only in the case where recover processing is independently performed for the printheads 5*a* and 5*b* but also in the case where recover processing is simultaneously performed for them. In addition, the amount of ink consumed in sucking operation can be reduced.

[Second Embodiment]

The first embodiment described above has exemplified the arrangement using the suction means as means for discharging ink from the respective nozzles. In this embodiment, as a means for discharging ink, a pressurizing means is used. Only the difference between the first and second embodiments will be described below, and a description of similar portions will be omitted.

Figure 2:
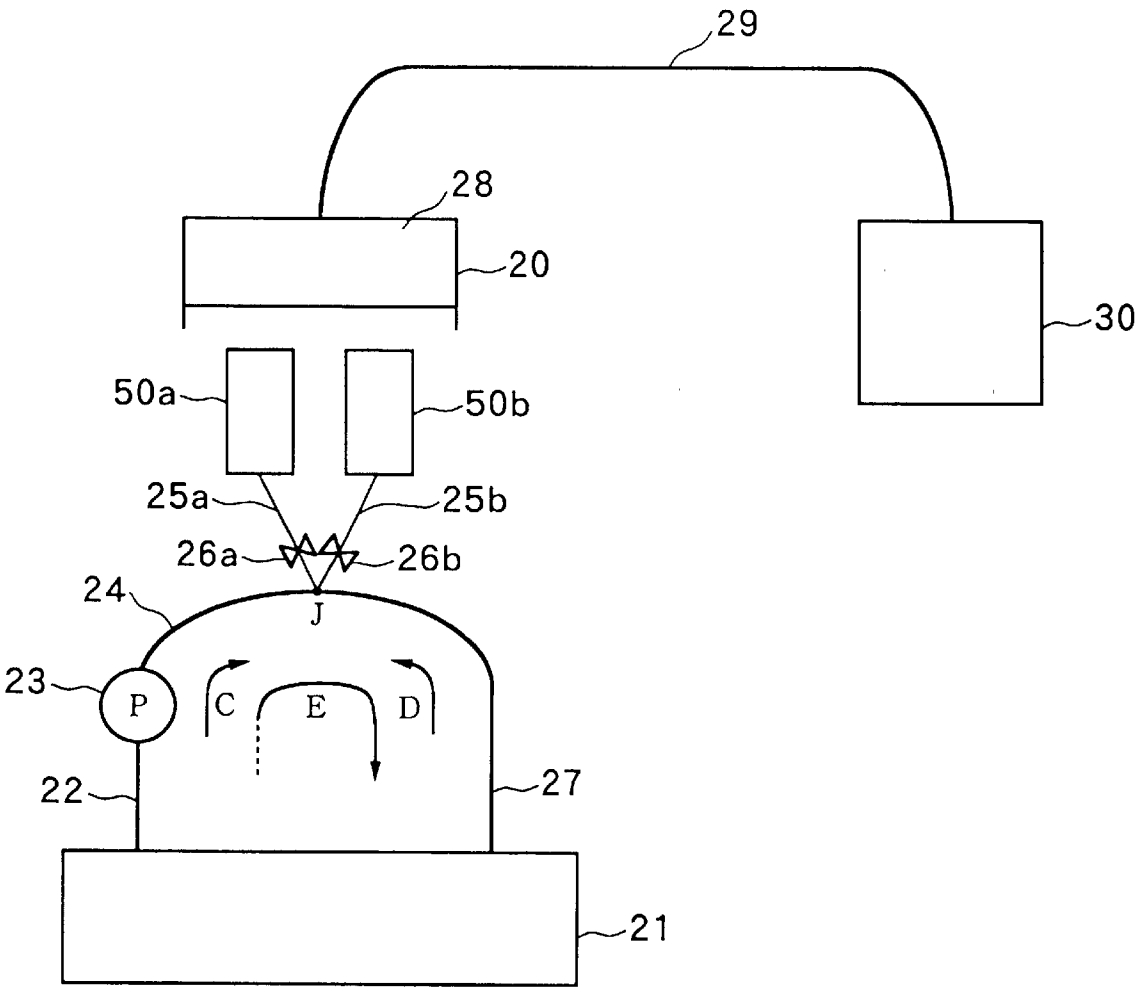
FIG. 2 is a view showing the arrangement of the main part of an ink-jet printer according to the second embodiment of the present invention.

FIG. 2 is a view showing ink supply routes to the respective printheads in this embodiment.

Referring to FIG. 2, reference numerals 50*a* and 50*b* denote printheads, each having 256 nozzles, ink channels, and electrothermal transducers, and a common liquid chamber as in the first embodiment.

Referring to FIG. 2, reference numeral 21 denotes an ink tank. When ink is discharged and consumed from the printheads 50*a* and 50*b* for printing, the ink reserved in the ink tank 21 is supplied using the capillary phenomenon along the route indicated by an arrow C in FIG. 2, which is constituted by an ink tube 22, tube pump 23, and ink tube 24, and the route indicated by an arrow D in FIG. 2, which is formed by an ink tube 27, so as to be supplied to the printheads 50*a* and 50*b* via a point J in FIG. 2, valves 26*a* and 26*b*, and ink tubes 25*a* and 25*b*.

Reference numeral 20 denotes a cap that comes into contact with the ejection surfaces of the printheads in recover processing, and has an ink absorbing member 28 inside; and 30, a waste ink tank for receiving and storing ink discharged from the printheads by recover processing. This tank is connected to the cap 20 via a tube 29.

In a normal state except when recover processing to be described below is performed, the tube pump 23 does not operate and is controlled by a control section to allow ink to pass.

In the normal state, the valves 26*a* and 26*b* are not closed, and hence ink can pass through the ink tubes 25*a* and 25*b*.

Recover processing in this embodiment will be described next.

The ink-jet printer of this embodiment includes dot counters for counting the numbers of dots printed by the printheads 50*a* and 50*b* as in the first embodiment. When the number of dots printed by each of the printheads 50*a* and 50*b* reaches a predetermined number (specifically, $3\times10^8$ dots in this embodiment as well), recover processing is performed to pressurize/discharge ink and small bubbles separated from dissolved gas in ink upon ink ejecting operation from the nozzles of the corresponding printhead after printing (one page).

When the recover processing is started, as a carriage 4 (see FIG. 1) moves, the printheads 50*a* and 50*b* move to the home positions to oppose the cap 20. A cap attaching/detaching mechanism (not shown) then brings the cap 20, which has an ink absorbing member 28 inside and is connected to the waste ink tank 30 via the tube 29, into contact with the printheads 50*a* and 50*b*. In this state, the tube pump 23 is driven.

When the tube pump 23 is driven, pressurized ink circulates as indicated by an arrow E in FIG. 2. In this embodiment, by controlling the closing and opening of the valves 26*a* and 26*b*, ink and small bubbles separated from dissolved gas in ink upon ink discharging operation can be selectively pressurized/discharged from the nozzles of the printhead 50*a* and/or the printhead 50*b* for which recover processing is required.

The pressurized/discharged ink is absorbed by the ink absorbing member 28 first and then guided to the waste ink tank 30 via the tube 29 by gravitation.

For example, the closing and opening of the valves 26*a* and 26*b* may be controlled such that the valves 26*a* and 26*b* are opened and closed, respectively, if recover processing is required only for the printhead 50*a*, and the valves 26*a* and 26*b* are closed and opened, respectively, if recover processing is required only for the printhead 50*b*. In addition, if recover processing is required for both the printheads, the two valves may be opened.

As in the first embodiment, it was confirmed that when the same operation were set for the tube pump 23 regardless of whether ink was pressured/discharged from one printhead or discharged from the two printheads, the pressurizing force applied to one printhead varied, and the amount of ink discharged became excessively small or large.

In this embodiment, if the same operation is set for the tube pump 23 regardless of whether ink was pressured/discharged from one printhead or discharged from the two printheads, the amount of ink discharged from one printhead when the two printheads were simultaneously pressurized become smaller than that when one printhead is pressurized by about 20%.

In this embodiment, therefore, the driving time during which the tube pump 23 is driven to simultaneously pressurize the printheads 50*a* and 50*b* is set to be longer by 20% than the driving time during which the tube pump 23 is driven to independently pressurize the printheads 50*a* and 50*b*.

Figure 5:
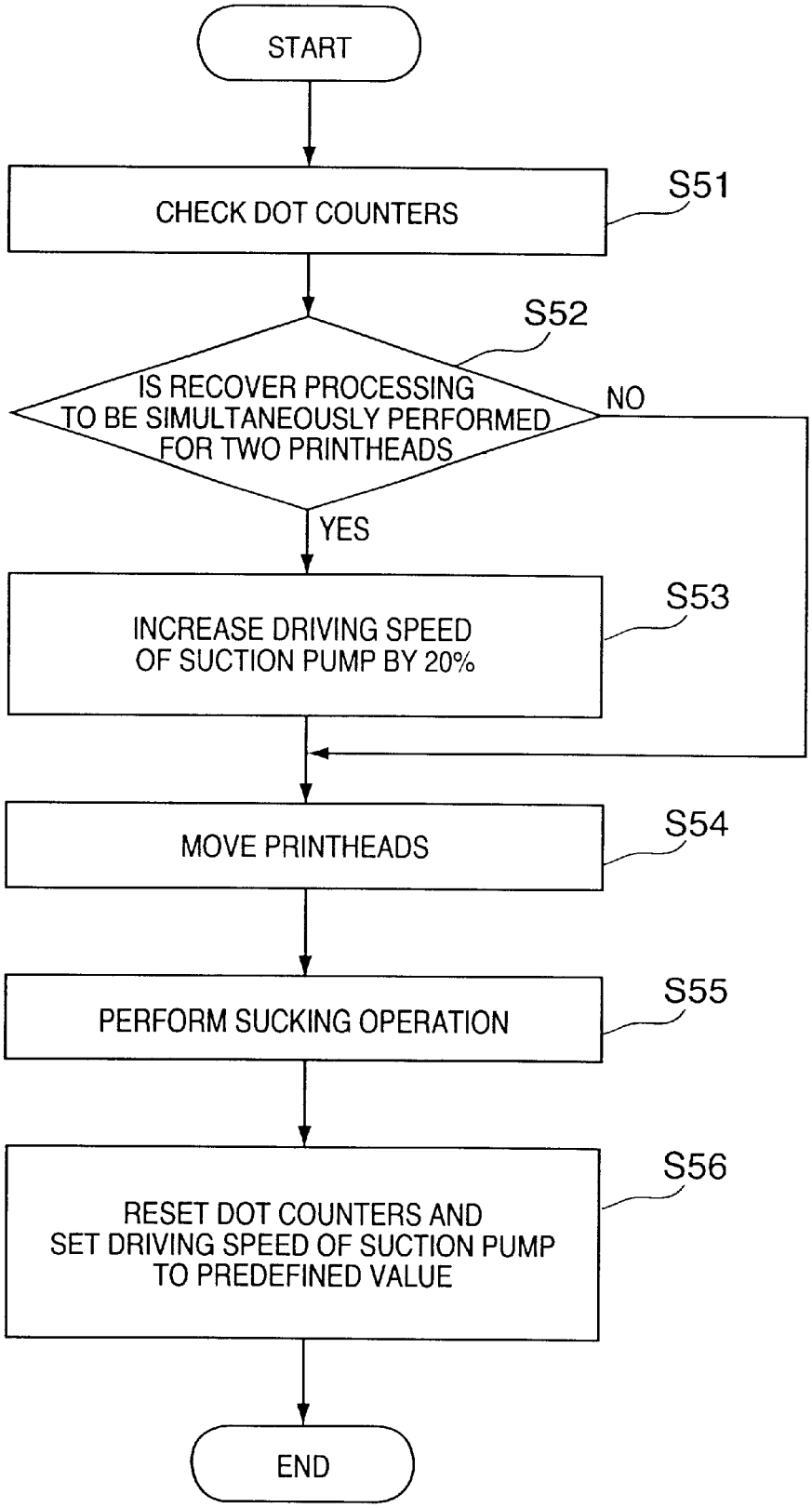
FIG. 5 is a flow chart showing recover processing in the first embodiment of the present invention.

In a flow chart for recover processing in this embodiment, therefore, "suction pump", "driving speed" and "suction operation" in the flow chart of FIG. 5 described in association with the first embodiment are respectively replaced with "tube pump", "driving time" and "pressure operation".

As described above, according to this embodiment, in the arrangement using the pressuring means as a means for discharging ink, as in the first embodiment, an ability high enough to remove a generated small bubbles can be ensured not only in the case where recover processing is independently performed for the two printheads but also in the case where recover processing is simultaneously performed for them. In addition, the amount of ink consumed by the recover processing can be reduced.

[Third Embodiment]

Each of the first and second embodiments described above has exemplified the case where recover processing is performed in units of printheads in the arrangement having two printheads. However, the present invention is not limited to this, and can be applied to an ink-jet printer having one printhead.

In this embodiment, an example for executing recover processing in units of nozzle arrays in an ink-jet printer having a single printhead including two nozzle arrays will be described. Only the difference between the third and first embodiments will be described below, and a description of similar portions will be omitted.

Figure 3A:
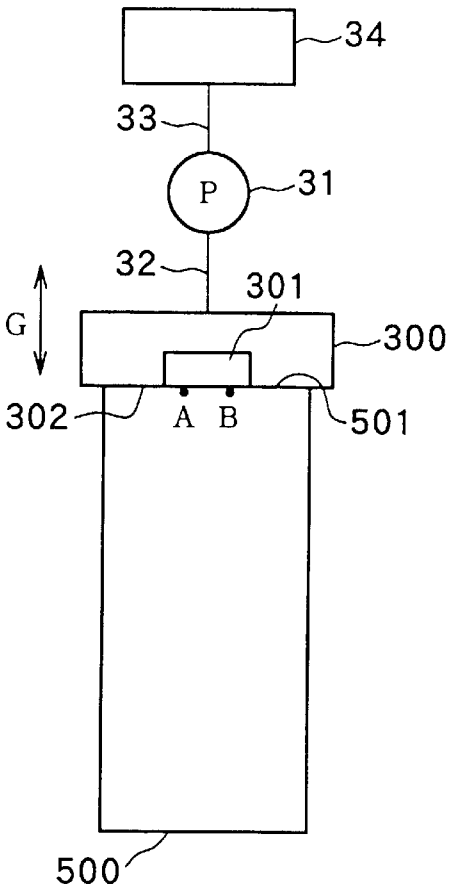
FIGS. 3A to 3C are explanatory views for recover processing in the third embodiment of the present invention.
Figure 3B:
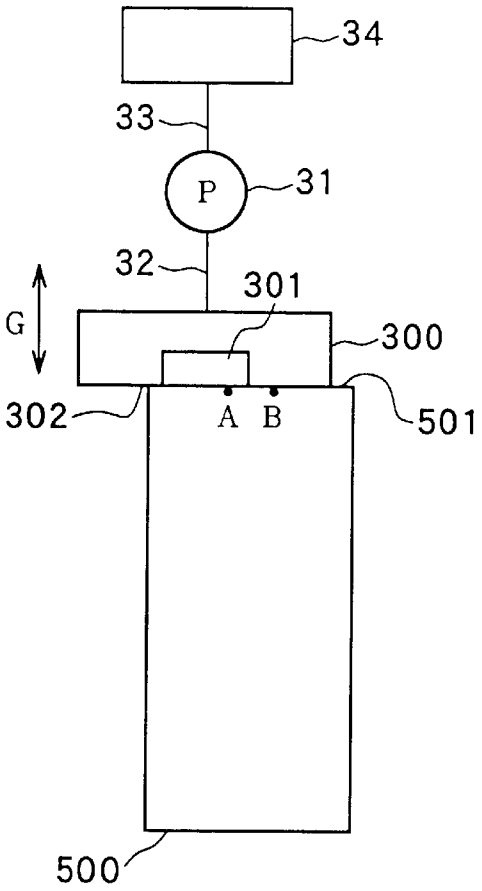
Figure 3C:
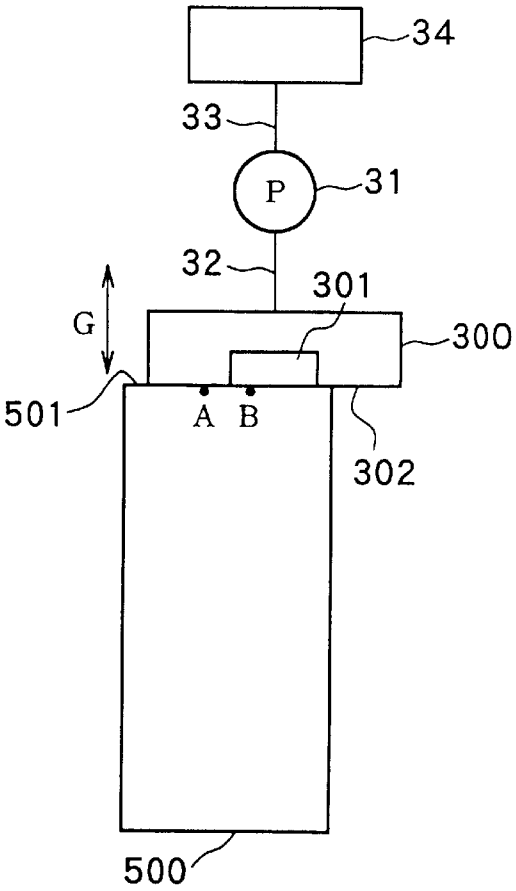

FIGS. 3A to 3C are schematic views for explaining recover processing in this embodiment, showing a state where a printhead 500 is viewed from the convey direction of a medium M (sub-scanning direction).

In the printhead 500, 256 nozzles are arranged in a line at 300-dpi intervals in the sub-scanning direction at each of positions A and B 1 mm apart from each other. Note that nozzle arrays A and B are arranged in a staggered pattern, and the printhead 500 has a total of 512 nozzles arranged at 600-dpi intervals in the sub-scanning direction.

Ink channels communicate with the respective nozzles, and electrothermal transducers are arranged in the respective ink channels. The respective ink channels communicate with a common liquid chamber, into which ink is supplied from an ink cartridge (not shown).

Referring to FIGS. 3A to 3C, reference numeral 300 denotes a suction cap having an internal space 301 which communicates with a suction pump 31 via a tube 32. The ink sucked by the suction pump 31 is guided and stored in a waste ink tank 34 via the tube 32, the suction pump 31, and a tube 33.

The suction cap 300 is reciprocally moved in the direction indicated by an arrow G in FIGS. 3A to 3C by a cap attaching/detaching mechanism (not shown) and controlled by a control section to be stopped in a state where a nozzle surface 501 of the printhead 500 is brought into contact with or separated from a head contact surface 302 of the suction cap 300.

Recover processing in this embodiment will be briefly described next.

The ink-jet printer of this embodiment uses, as a method of detecting a nozzle whose ejection performance has deteriorated, a method of printing a test pattern and allowing a user to visually check the print result to detect a nozzle whose ejection performance has deteriorated. In addition, such a test pattern is designed to allow the user not only to detect the presence/absence of a nozzle having undergone a deterioration in ejection performance by visually checking the pattern but also to detect which one of the nozzle arrays A and B in FIG. 3A the nozzle having undergone the deterioration in ejection performance is located in.

This printer also has a recover processing instructing means by which the user can give an instruction to perform recover processing upon detecting a nozzle having undergone a deterioration in ejection performance. This recover processing instructing means is configured to allow the user to select one of the following three processes: recover processing (to be referred to as recover processing for only A hereafter) for only nozzles located in the nozzle array A in FIG. 3A; recover processing (to be referred to as recover processing for only B hereinafter) for only nozzles located in the nozzle array B; and recover processing (to be referred to as recover processing for A and B hereinafter) for all the nozzles.

FIG. 3A shows a state where recover processing is performed for the nozzles of the two nozzle arrays A and B, i.e., all the nozzles. FIG. 3B shows a state where recover processing is performed for only the nozzle array A. FIG. 3C shows a state where recover processing is performed for only the nozzle array B.

If, for example, recover processing for only the nozzle array A is designated, a carriage 4 (see FIG. 1) on which the printhead 500 is mounted moves to the position shown in FIG. 3B. Thereafter, the head contact surface 302 of the suction cap 300 is brought into contact with the nozzle surface 501 of the printhead 500 by the cap attaching/detaching mechanism (not shown).

When the head contact surface 302 of the suction cap 300 is brought into contact with the nozzle surface 501 of the printhead 500, the suction pump 31 is started to suck/discharge ink and a factor that has caused a deterioration in ink ejection performance (e.g., bubbles in ink channels and dust adhering to the nozzle surface 501) from the respective nozzles of the nozzle array A of the printhead 500. At this time, the respective nozzles of the nozzle array B shown in FIG. 3B are covered with the head contact surface 302 of the suction cap 300, and hence no ink is sucked/discharged. That is, ink is sucked/discharged from only the nozzles of the nozzle array A.

This arrangement and control can prevent unnecessary ink discharge from the nozzles of the nozzle array B in which no nozzle having undergone a deterioration in ejection performance is present.

Similarly, when recover processing for only the nozzle array B is designated, the carriage 4 moves to the position shown in FIG. 3C, and the head contact surface 302 of the suction cap 300 is brought into contact with the nozzle surface 501 of the printhead 500. Thereafter, the suction pump 31 is started to suck and discharge ink from the respective nozzles of the nozzle array B in FIG. 3C in the same manner as described above.

When recover processing for the two nozzle arrays is designated, the carriage 4 moves to the position shown in FIG. 3A, and the head contact surface 302 of the suction cap 300 is brought into contact with the nozzle surface 501 of the printhead 500. The suction pump 31 is then started to suck and discharge ink and factors that have caused a deterioration in ink ejection performance from all the nozzles arranged on the printhead 500.

In this embodiment as well, it was confirmed that if the same operation is set for the suction pump 31 regardless of whether recover processing was required for one or two nozzle arrays, i.e., recover processing for only A or B or A and B was selected, since the ink reserved in the same ink cartridge is supplied to both of the nozzle arrays A and B, different suction capabilities for respective nozzles were caused, and the suction amount became excessively small or large.

In the arrangement of this embodiment as well, it was confirmed that the suction amount in recover processing for the two nozzle arrays is smaller than that in recover processing for only the nozzle array A or B by about 20%.

In this embodiment, therefore, to substantially equalize the suction amounts from the respective nozzles between the above cases, the suction time in recover processing for the two nozzle arrays is set to be longer than that in recover processing for only the nozzle array A or B by 20%.

As described above, according to this embodiment, in the arrangement having the two nozzle arrays, an ability high enough to eliminate factors that have caused a deterioration in ink ejection performance can be ensured not only in the case where recover processing is independently performed for the two nozzle arrays but also in the case where recover processing is simultaneously performed for them. In addition, the amount of ink consumed for recovering operation can be reduced.

This embodiment has exemplified the arrangement using the ejection performance deteriorating nozzle detection means for allowing the user to visually check a printed test pattern. However, the present invention is not limited to the ejection performance deteriorating nozzle detection means of this scheme. The present invention may use a scheme of automatically detecting such a nozzle on a printed test pattern by using an optical system or the like in the apparatus or a scheme of automatically detecting an ink ejection state itself by using an optical system or the like.

In this case, the printer may be configured/controlled to automatically perform recover processing in accordance with the data detected by a detection means.

[Other Embodiment]

Note that in the above first to third embodiments, examples for applying the present invention to an ink-jet printer of a serial scanning type in which the printheads mounted on the carriage are reciprocally scanned onto the medium being transferred intermittently, however, the present invention can be applied to an ink-jet printer of a full-line type in which nozzles are arranged along the width direction of the medium, and only the medium is transferred while printing.

In addition, as to the ink-jet printhead, not only the printhead described in the above embodiments in which ink is ejected by a pressure due to film boiling caused by local heating, but the printhead of the other type, for example, a printhead using a piezoelectric element, can be employed with the present invention.

Further, in the above embodiments, an example of an ink-jet printer using one kind of ink for printing is described, the printer according to the present invention may use a plural kinds of ink.

In this case, it is not necessary to apply the present invention to all nozzles to which any of the plural kinds of ink is supplied. The advantages of the present invention may be effected satisfactory even if the present invention is applied at least to nozzles to which one of the plural kinds of ink is supplied.

Moreover, in the above embodiments, the number of the printheads to which the same kinds of ink is supplied is equal to or less than two, the present invention is not limited to these types, and the number of the printheads to which the same kinds of ink is supplied may be three or more.

Further, in the above embodiments, an example of recover processing performed to nozzles belonging to respective or both of two groups in which all of nozzles to which the same kind of ink is supplied are divided into the two groups is described, the number of divided groups is not limited to two and may be three or more. In this case, if the number of divided groups is three or more, the present invention is more effective.

Moreover, in the above embodiments, the number of nozzles belonging to each of the divided groups are the same, it is not necessary to set the number of nozzles in the divided groups to the same number, and may be different with each other.

Further, in the above embodiments, an example of recover processing in which driving speed of a suction pump, driving time of a tube pump, and suction time of a suction pump are controlled is described, the present invention is not limited to the example, and may have another construction, for example, a construction including a plurality kinds of pumps being operated by switching.

Moreover, the suction time in the present invention may include a time period between time the pump being stopped and time the suction cap being separated from the liquid ejection surface, in addition to the pump driving time.

In the above embodiments, droplets ejected from the printhead are ink droplets, and a liquid stored in the ink tank is ink. However, the liquid to be stored in the ink tank is not limited to ink. For example, a treatment solution to be ejected onto a printing medium so as to improve the fixing property or water resistance of a printed image or its image quality may be stored in the ink tank.

Each of the embodiments described above has exemplified a printer, which comprises means (e.g., an electrothermal transducer, laser beam generator, and the like) for generating heat energy as energy utilized upon execution of ink ejection, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By ejecting the liquid (ink) through a ejection opening by growth and shrinkage of the bubble, at least one droplet is formed. If the driving signal is applied as a pulse signal, the growth and shrinkage of the bubble can be attained instantly and adequately to achieve ejection of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of ejection nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a ejection portion of the electrothermal transducers, or Japanese Patent Laid-Open No. 59-138461 which discloses the arrangement having an opening for absorbing a pressure wave of heat energy in correspondence with a ejection portion. Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary ejection mode which performs ejecting independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable ejection range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is ejected in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

If the present invention is realized as a storage medium, program codes corresponding to the above mentioned flowcharts (FIG. 5) are to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. A liquid ejecting apparatus comprising:

a plurality of liquid ejection openings to which liquid reserved in the same liquid reservoir means is supplied;

ejection performance maintaining and recovering means for forcibly discharging the liquid from liquid ejection openings selected from the plurality of liquid ejection openings; and control means for controlling the ejection performance maintaining and recovering means in accordance with number of selected liquid ejection openings so as to substantially equalize an amount of ink discharged from each of the liquid ejection openings, regardless of the number of selected liquid ejection openings.

2. The apparatus according to claim 1, wherein said ejection performance maintaining and recovering means includes negative pressure generating means and forcibly discharges liquid from selected liquid ejection openings with a negative pressure generated by said negative pressure generating means.

3. The apparatus according to claim 1, wherein said ejection performance maintaining and recovering means includes pressure generating means in a liquid supply path to the plurality of liquid ejection openings, and forcibly discharges liquid from selected liquid ejection openings with a pressure generated by said pressure generating means.

4. The apparatus according to claim 1, wherein said plurality of liquid ejection openings are divided into a plurality of liquid ejection opening groups each having a same number of liquid ejection openings, said ejection performance maintaining and recovering means forcibly discharges the liquid from liquid ejection openings belonging to liquid ejection opening groups selected from the plurality of liquid ejection opening groups, and said control means controls the ejection performance maintaining and recovering means in accordance with number of selected liquid ejection opening groups so as to substantially equalize an amount of ink discharged from each of the liquid ejection openings, regardless of the number of selected liquid ejection opening groups.

5. The apparatus according to claim 4, wherein said plurality of liquid ejection opening groups each having a same number of liquid ejection openings are provided on respective liquid ejecting heads, said ejection performance maintaining and recovering means forcibly discharges the liquid from liquid ejection openings belonging to liquid ejecting heads selected from the plurality of liquid ejecting heads, and said control means controls the ejection performance maintaining and recovering means in accordance with number of selected liquid ejecting heads so as to substantially equalize an amount of ink discharged from each of the liquid ejection openings, regardless of the number of selected liquid ejecting heads.

6. The apparatus according to claim 1, further comprising detection means for detecting a liquid ejection opening that requires the ejection performance maintaining and recovering operation.

7. The apparatus according to claim 1, wherein said apparatus ejects liquid by using heat energy.

8. The apparatus according to claim 1, wherein said apparatus performs printing by ejecting liquid onto a printing medium.

9. A method for maintaining and recovering ejection performance of an apparatus having a plurality of liquid ejection openings to which liquid reserved in the same liquid reservoir means is supplied, said method comprising the steps of:

ejection performance maintaining and recovering step for performing ejection performance maintaining and recovering operation which forcibly discharges the liquid from liquid ejection openings selected from the plurality of liquid ejection openings; and control step for controlling the ejection performance maintaining and recovering operation in accordance with number of selected liquid ejection openings so as to substantially equalize an amount of ink discharged from each of the liquid ejection openings, regardless of the number of selected liquid ejection openings.

10. The method according to claim 9, wherein in said ejection performance maintaining and recovering step, the liquid is forcibly discharged from selected liquid ejection openings with a negative pressure generated by negative pressure generating means.

11. The method according to claim 9, wherein in said ejection performance maintaining and recovering step, the liquid is forcibly discharged from selected liquid ejection openings with a pressure generated by pressure generating means provided in a liquid supply path to the plurality of liquid ejection openings.

12. The method according to claim 9, wherein said plurality of liquid ejection openings are divided into a plurality of liquid ejection opening groups each having a same number of liquid ejection openings, in said ejection performance maintaining and recovering step, the liquid is forcibly discharged from liquid ejection openings belonging to liquid ejection opening groups selected from the plurality of liquid ejection opening groups, and in said control step, the ejection performance maintaining and recovering operation is controlled in accordance with number of selected liquid ejection opening groups so as to substantially equalize an amount of ink discharged from each of the liquid ejection openings, regardless of the number of selected liquid ejection opening groups during the ejection performance maintaining and recovering operation.

13. The method according to claim 12, wherein said plurality of liquid ejection opening groups each having a same number of liquid ejection openings are provided on respective liquid ejecting heads, in said ejection performance maintaining and recovering step, the liquid is forcibly discharged from liquid ejection openings belonging to liquid ejecting heads selected from the plurality of liquid ejecting heads, and in said control step, the ejection performance maintaining and recovering operation is controlled in accordance with number of selected liquid ejecting heads so as to substantially equalize an amount of ink discharged from each of the liquid ejection openings, regardless of the number of selected liquid ejecting heads during the ejection performance maintaining and recovering operation.

14. The method according to claim 9, further comprising detection step for detecting a liquid ejection opening that requires the ejection performance maintaining and recovering operation.

15. A storage medium for storing a code of a program for implementing the method of ejection performance maintaining and recovering operation according to claim 9.

* * * * *